US005669640A

United States Patent [19]

Ryan

[11] Patent Number: 5,669,640

[45] Date of Patent: Sep. 23, 1997

[54] DOOR LATCH

[76] Inventor: Charles R. Ryan, 133 Woodsdale Dr., Mogadore, Ohio 44260

[21] Appl. No.: 581,896

[22] Filed: Jan. 2, 1996

[51] Int. Cl.[6] ..... E05C 19/18

[52] U.S. Cl. ..... 292/259 R; 292/67; 292/205; 292/281

[58] Field of Search ..... 292/259 R, 67, 292/281, 282, 289, 205

[56] References Cited

U.S. PATENT DOCUMENTS

| | | | |
|---|---|---|---|
| 275,026 | 4/1883 | Dayton | 292/282 |
| 474,021 | 5/1892 | Linindoll | 292/281 |
| 546,164 | 9/1895 | Knight | 292/259 R |
| 1,797,634 | 3/1931 | Bruce | 292/281 |
| 2,702,866 | 2/1955 | Anderson | 292/67 |
| 3,592,497 | 7/1971 | Logan, Jr. | 292/259 |
| 3,815,389 | 6/1974 | Richards, Sr. | 70/78 |
| 3,897,094 | 7/1975 | Schuller | 292/283 |
| 4,429,911 | 2/1984 | O'Neal et al. | 292/259 |
| 4,601,503 | 7/1986 | Wicks, Sr. | 292/259 |
| 4,667,992 | 5/1987 | Roden, Jr. | 292/259 |
| 5,232,254 | 8/1993 | Teaff | 292/259 |

FOREIGN PATENT DOCUMENTS

| | | | |
|---|---|---|---|
| 345113 | 12/1921 | Germany | 292/282 |

*Primary Examiner*—Rodney M. Lindsey
*Attorney, Agent, or Firm*—Sand & Sebolt

[57] ABSTRACT

A door securing device with an elongated, rigid bar that is attachable to a pair of lock posts affixed to the door or door frame of the building or other secured area to be protected against unwanted entry. The bar has an opening in each of its ends, each for receiving one of the lock posts. The first lock post has a groove therein in which the bar slides within the constraints of the opening corresponding with that post. The second lock post has a narrow neck which receives the bar via the corresponding opening therein, and an enlarged base which receives and locks the bar in place when the bar is axially slid along the post thereby allowing a lock to be closed over the narrow neck to secure the door of the building.

19 Claims, 11 Drawing Sheets

24
28
26
30
32
36
20
34
22

FIG-2
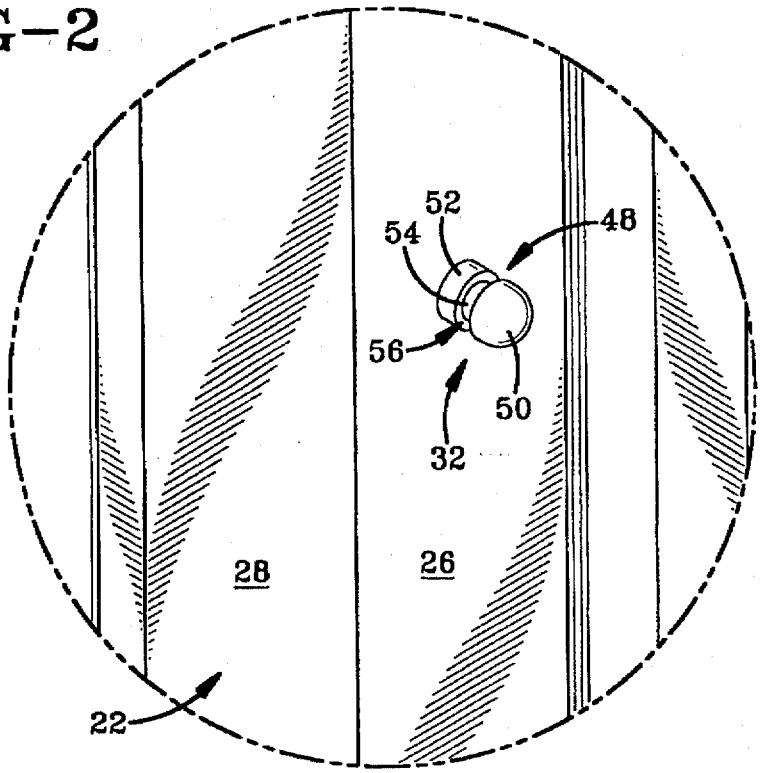
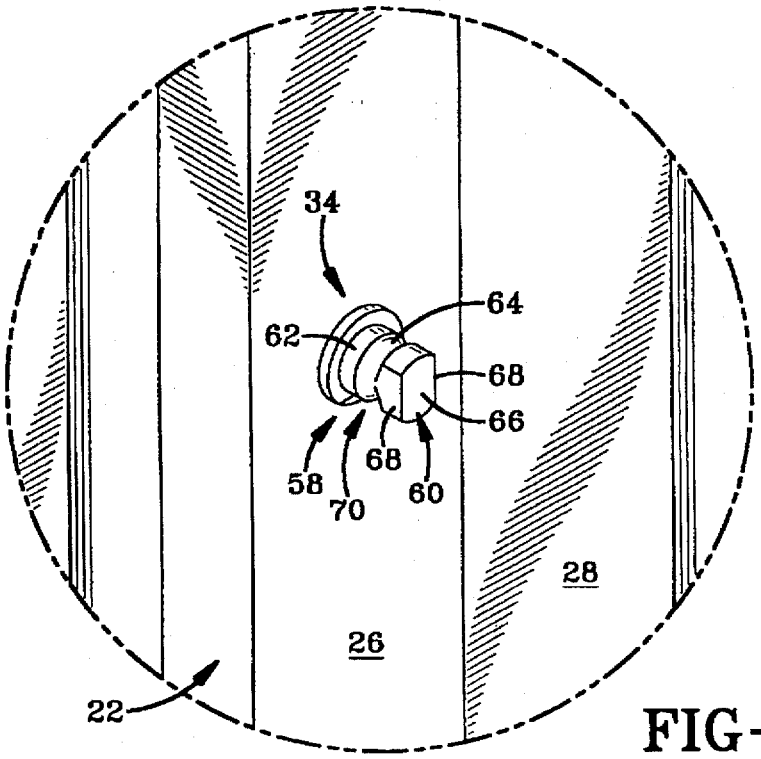
FIG-2A

FIG-3
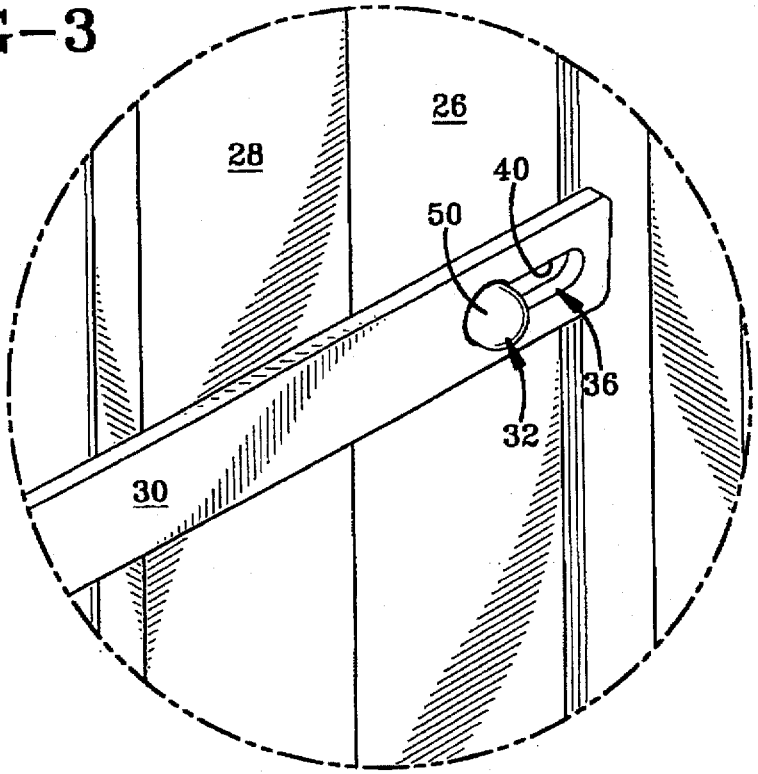
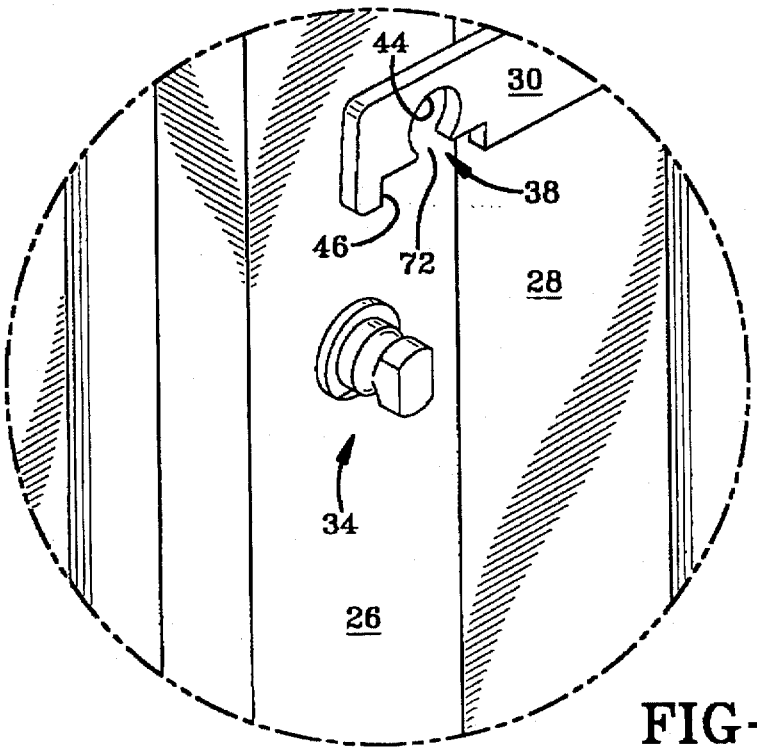
FIG-3A

FIG-4
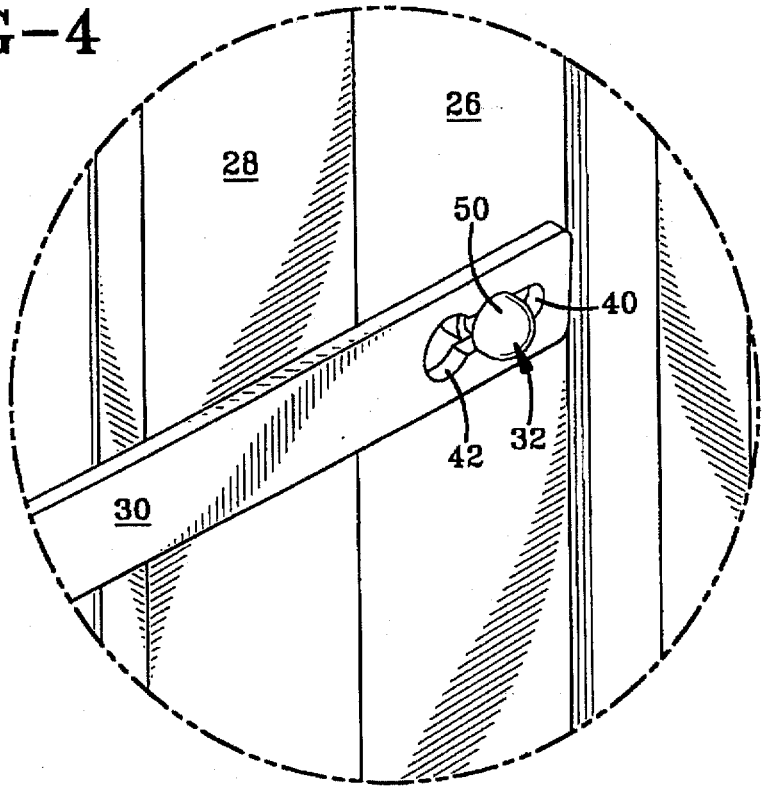
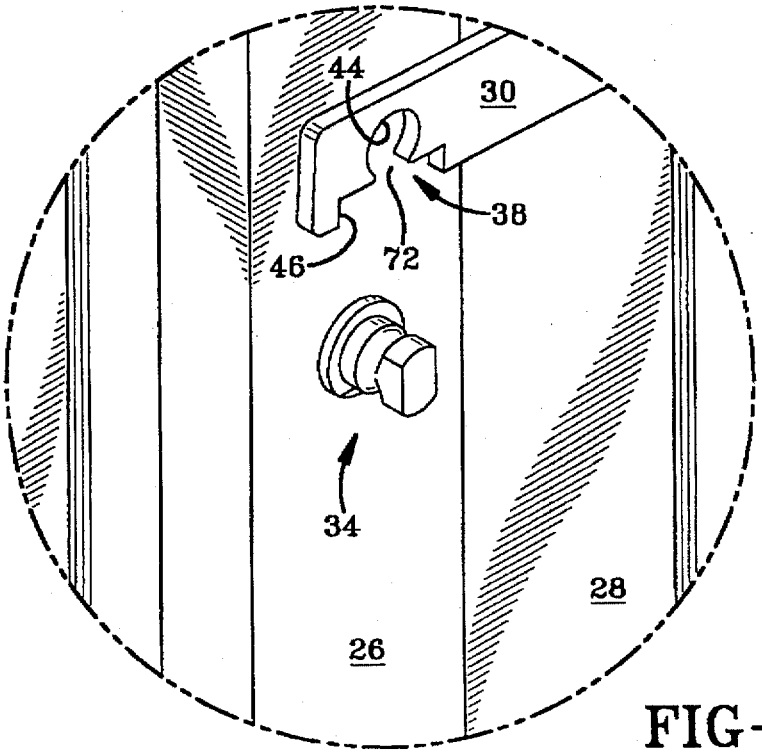
FIG-4A

FIG-5
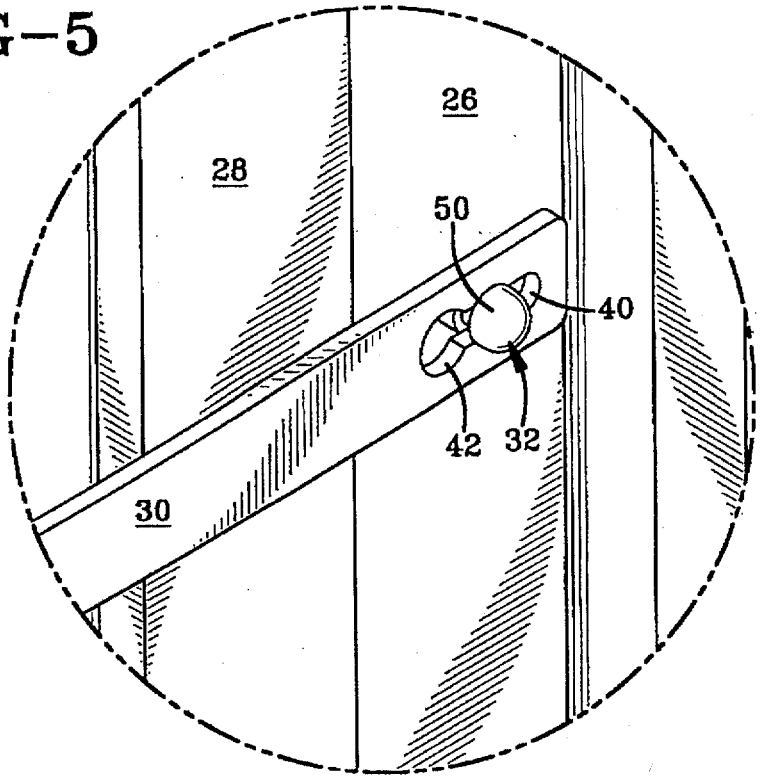
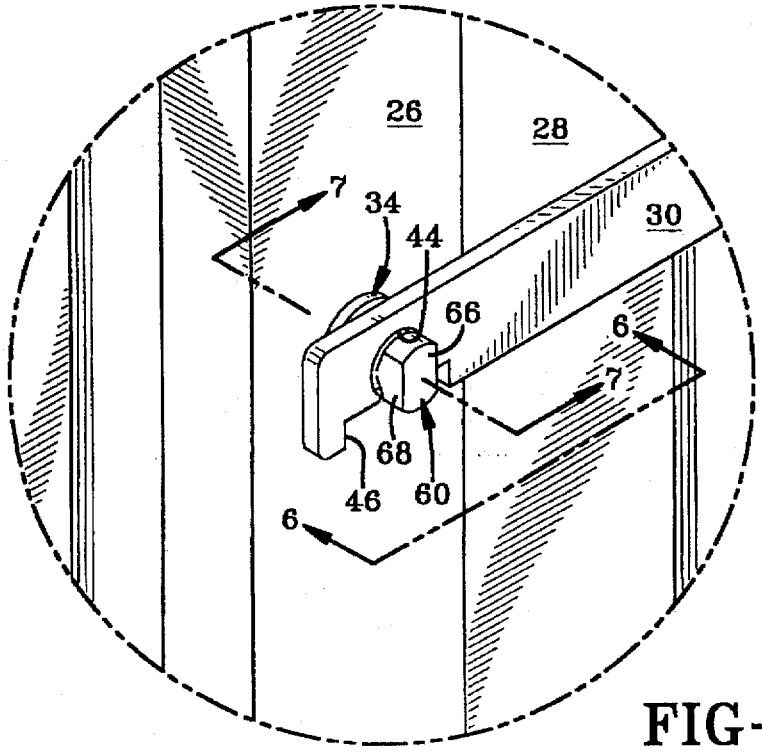
FIG-5A

FIG-6
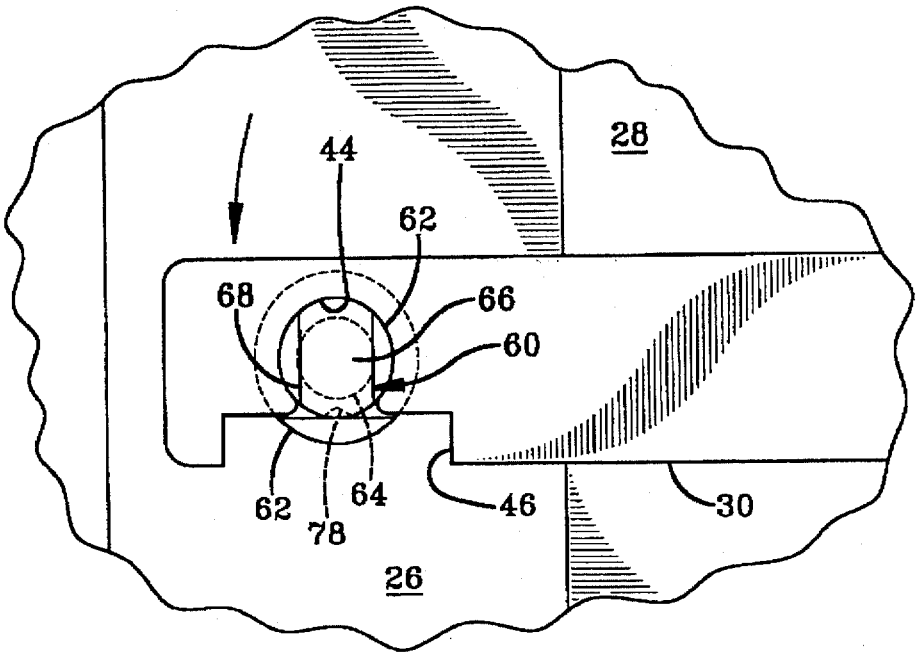
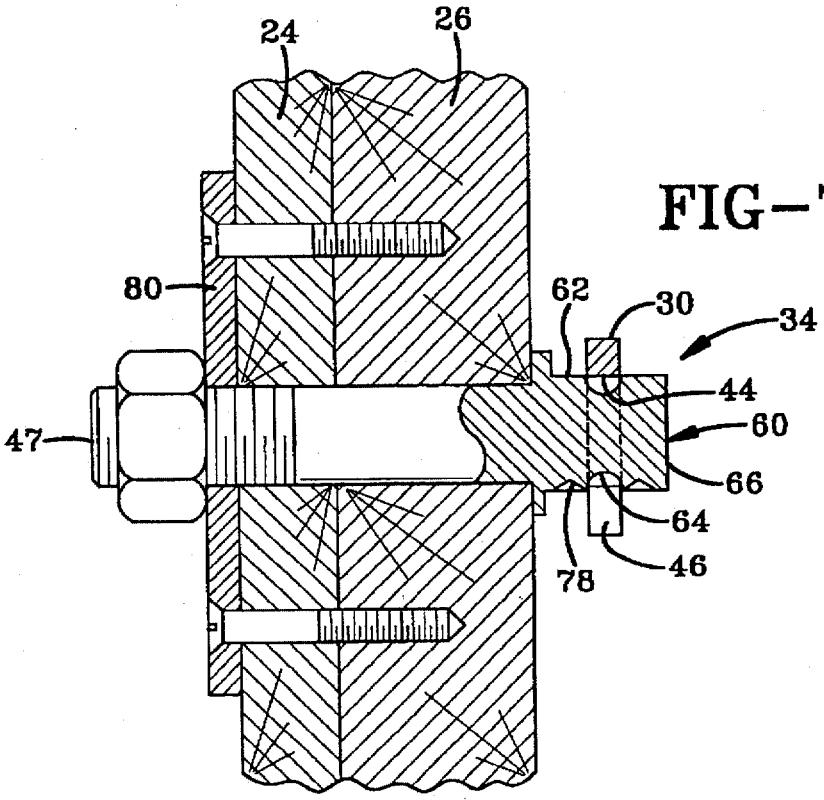
FIG-7

FIG-8
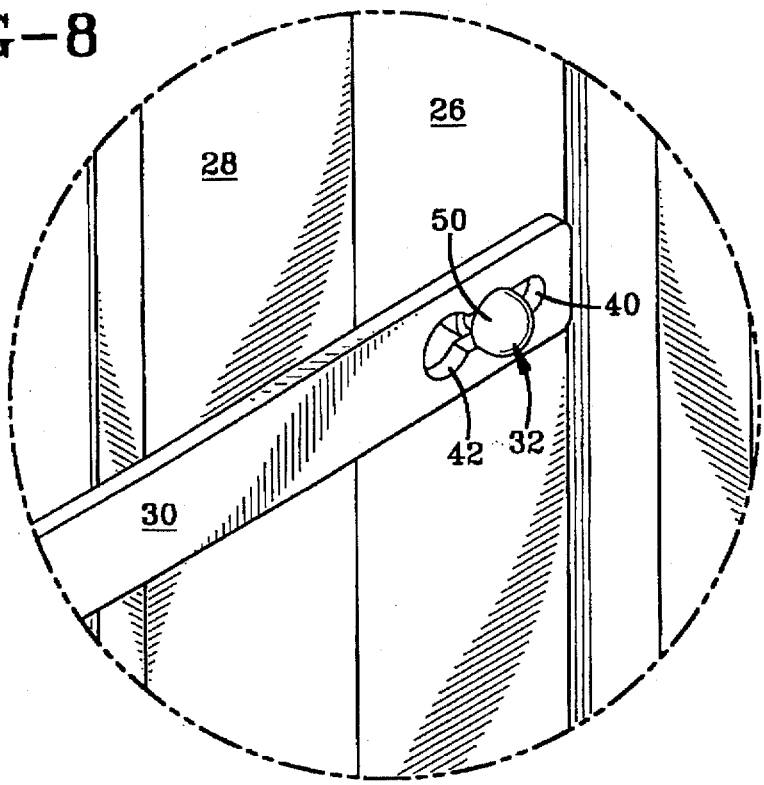
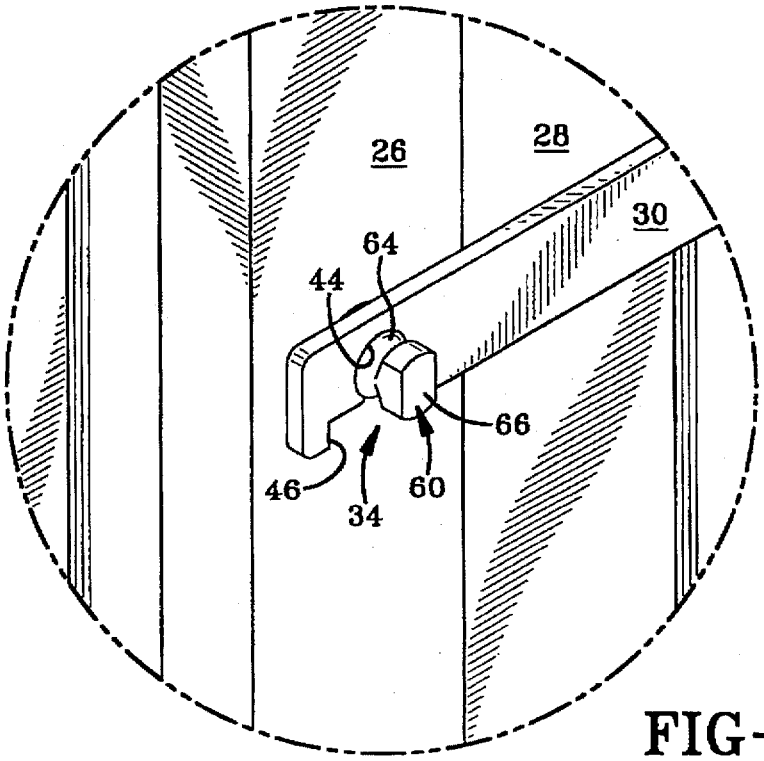
FIG-8A

FIG-10
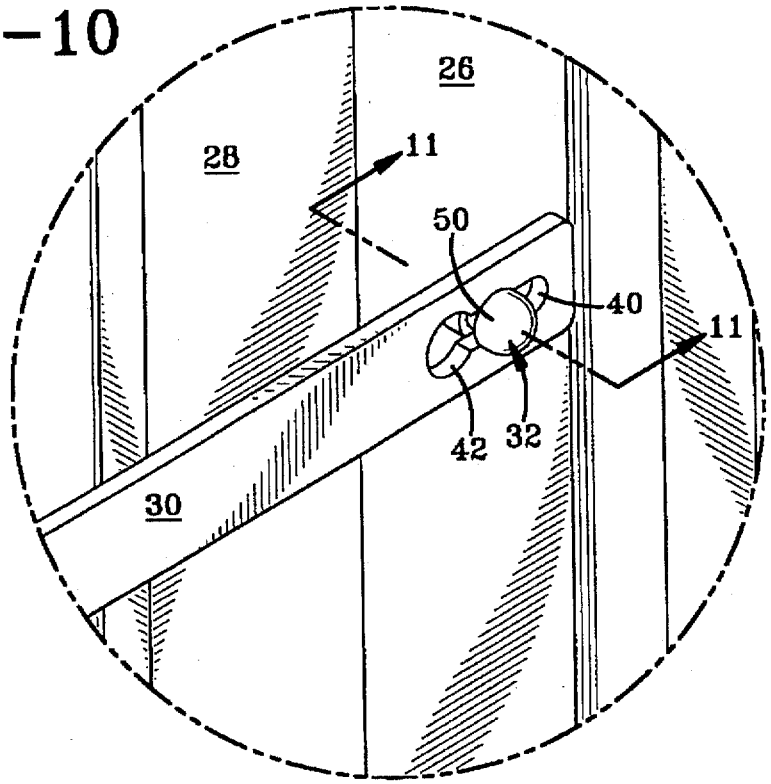
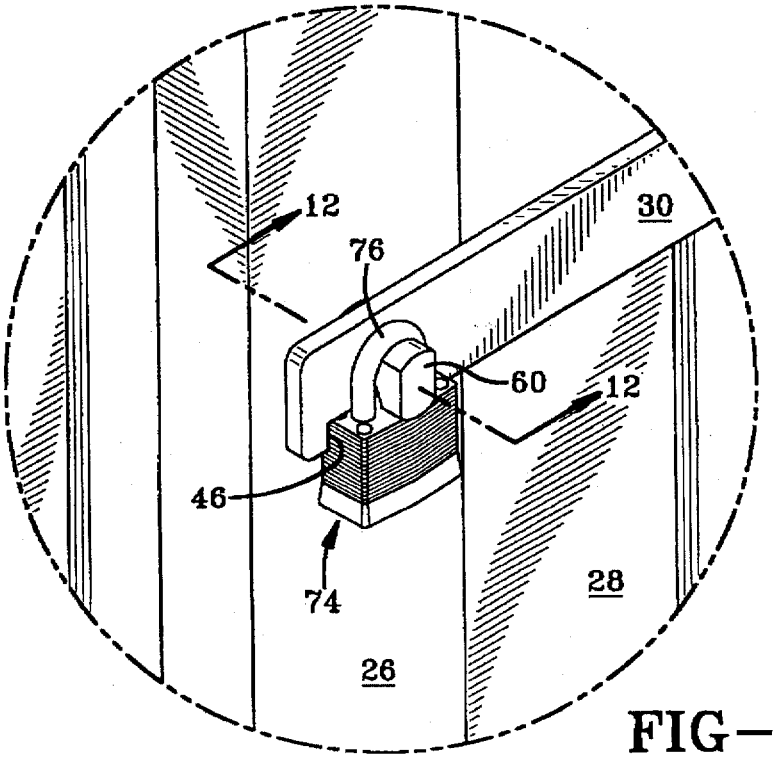
FIG-10A

DOOR LATCH

BACKGROUND OF THE INVENTION

1. Technical Field

The invention relates generally to a door securing device for buildings and cabinets. More particularly, the invention relates to bar locks which extend across door openings when the door is in the closed position. Specifically, the invention relates to a door securing device that easily slides into place, securely locks the door, and which secures the lock from being removed by cutting.

2. Background Information

Belongings have been stored in homes, buildings, barns, sheds, cabinets, and other enclosed and defined areas for many years. Typically, these enclosed areas have doors or other access panels through which stored items are removed for use and later returned for storage.

In more recent years, barns, pole buildings, sheds, garages, and other detached buildings have been used to store farm equipment, tractors, cars, ladders, gardening tools, etc. Individuals have stored their belongings in buildings to prevent damage from rain and weather in the past, and more recently have secured the same within storage buildings and cabinets to prevent the theft of the belongings. Specifically, as petty theft and other crimes continue to increase, so does the need to secure belongings within a locked structure. For these reasons, the ability to secure the doors or other access panels to buildings has become important.

Various door latches, hasps, and locks exist that help to deter access to a secured building. However, several problems exist with the use of these known latches and locks.

One problem associated with previous door latches, hasps and locks, is that key portions of the securing mechanism remain unprotected. For example, the U-shaped bolt on a standard padlock remains exposed when used with most door latches and hasps. Specifically, the U-shaped bolt is the part of the padlock that extends and retracts from the lock body. One side of the U-shaped bolt is permanently attached to the lock body while the other side is removable and pivotable about the permanently attached side when the U-shaped bolt is extended. The exposure of the bolt invites a burglar to cut the bolt with any of a variety of bolt cutting mechanisms, including bolt cutters and hack saws. If the U-shaped bolt on a standard padlock is cut, the burglar essentially circumvents the need to operate the tumbling mechanism by either combination or key entry thereby gaining unwanted access into the previously secured structure.

A second problem associated with previous latches and locks is the lack of rigidity offered by standard latches and locks which merely connect adjacent portions of adjacent doors. Often the doors are secured together but are still subject to movement, twisting, and even some separation. In addition, often the doors are not secured tightly to a frame although the doors are secured together. This lack of rigidity in conventional latches and locks offers leverage and better access to the latch or securing mechanism which makes the mechanism as well as the door more susceptible to damage and breakage which could result in unwanted entry.

Additionally, existing door hasps and latches are often secured via threaded fasteners directly to the wood on either the door, or the frame surrounding the door such that unwanted entry may be achieved by merely prying the hasp loose from the structure thereby circumventing the lock operatively connected to the hasp.

Therefore, the need exists for a door latch which securely mounts to the structure and prevents removal of the latch from the structure, which secures a standard padlock having a U-shaped bolt thereto. The need also exists for a door latch which effectively prevents the U-shaped bolt of a standard padlock from being removed via bolt cutters or other evasive tools thus securely retaining the same against movement relative to the latch.

SUMMARY OF THE INVENTION

Objectives of the invention include providing a door latch that is resistant to vandalism.

Another objective of the invention is to provide a door latch which operates to prevent the U-shaped bolt from being cut.

A further objective of the invention is to provide a locking post on which a standard padlock may be affixed.

A still further objective of the present invention is to provide a door latch that secures a pair of doors snugly to the door frame thereby reducing leverage during an attempted break-in.

Yet another objective of the present invention is to provide a door latch which is simple to install and simple to operate during use.

Still another objective of the invention is to provide a door latch which may be mounted on both a single swinging door or opposing double doors, merely by varying the length of the bar extending across the door opening.

Another objective of the present invention is to provide a door latch having a first post mounted on one side of the door, and a second post mounted on the other side of the door, with a bar pivotally mounted on the first post, and moving between an engaging and a non-engaging position with the second bar.

A still further objective is to provide such a door latch which is of simple construction, which achieves the stated objectives in a simple, effective and inexpensive manner, and which solves problems and satisfies needs existing in the art.

These and other objectives and advantages of the invention are obtained by the improved door securing mechanism of the present invention, the general nature of which may be stated as including an elongated, rigid bar having first and second openings formed therein; a first lock post insertable in the first opening and selectively securable therein; and a second lock post insertable in the second opening and including a pad lock receiving groove formed therearound for selectively securing the elongated, rigid bar to the second lock post.

BRIEF DESCRIPTION OF THE DRAWINGS

Preferred embodiments of the invention, illustrative of the best modes in which the applicant has contemplated applying the principles, are set forth in the following description and are shown in the drawings and are particularly and distinctly pointed out and set forth in the appended claims.

FIG. 2 is a fragmentary perspective view of a first lock post on the door securing device as shown in FIG. 1;

FIG. 2A is a fragmentary perspective view of a second lock post on the door securing device as shown in FIG. 1;

FIG. 3 is a fragmentary perspective view of the first lock post and the elongated, rigid bar in a first position;

FIG. 3A is a fragmentary perspective view of the second lock post and the elongated, rigid bar in a first position;

FIG. 4 is a fragmentary perspective view similar to FIG. 3 with the elongated, rigid bar shown in a second position;

FIG. 4A is a fragmentary perspective view similar to FIG. 3A with the elongated, rigid bar shown in a second position;

FIG. 5 is a fragmentary perspective view similar to FIG. 4 and shown in a third position;

FIG. 5A is a fragmentary perspective view similar to FIG. 4A with the elongated, rigid bar shown in a third position;

FIG. 6 is a fragmentary front elevational sectional looking in the direction of line 6—6, with the elongated, rigid bar shown in dot-dash lines in a first position, and in solid lines in a second position;

FIG. 7 is a sectional view taken along line 7—7, FIG. 5A with portions cut away;

FIG. 8 is a fragmentary perspective view similar to FIG. 4 and shown in a fourth position;

FIG. 8A is a fragmentary perspective view similar to FIG. 5A with the elongated, rigid bar shown in a fourth position;

FIG. 10 is a fragmentary perspective view similar to FIG. 8;

FIG. 10A is a fragmentary perspective view similar to FIG. 9A with the pad lock locked around the second lock post;

Similar numerals refer to similar parts throughout the drawings.

DESCRIPTION OF THE PREFERRED EMBODIMENT

Figure 1:
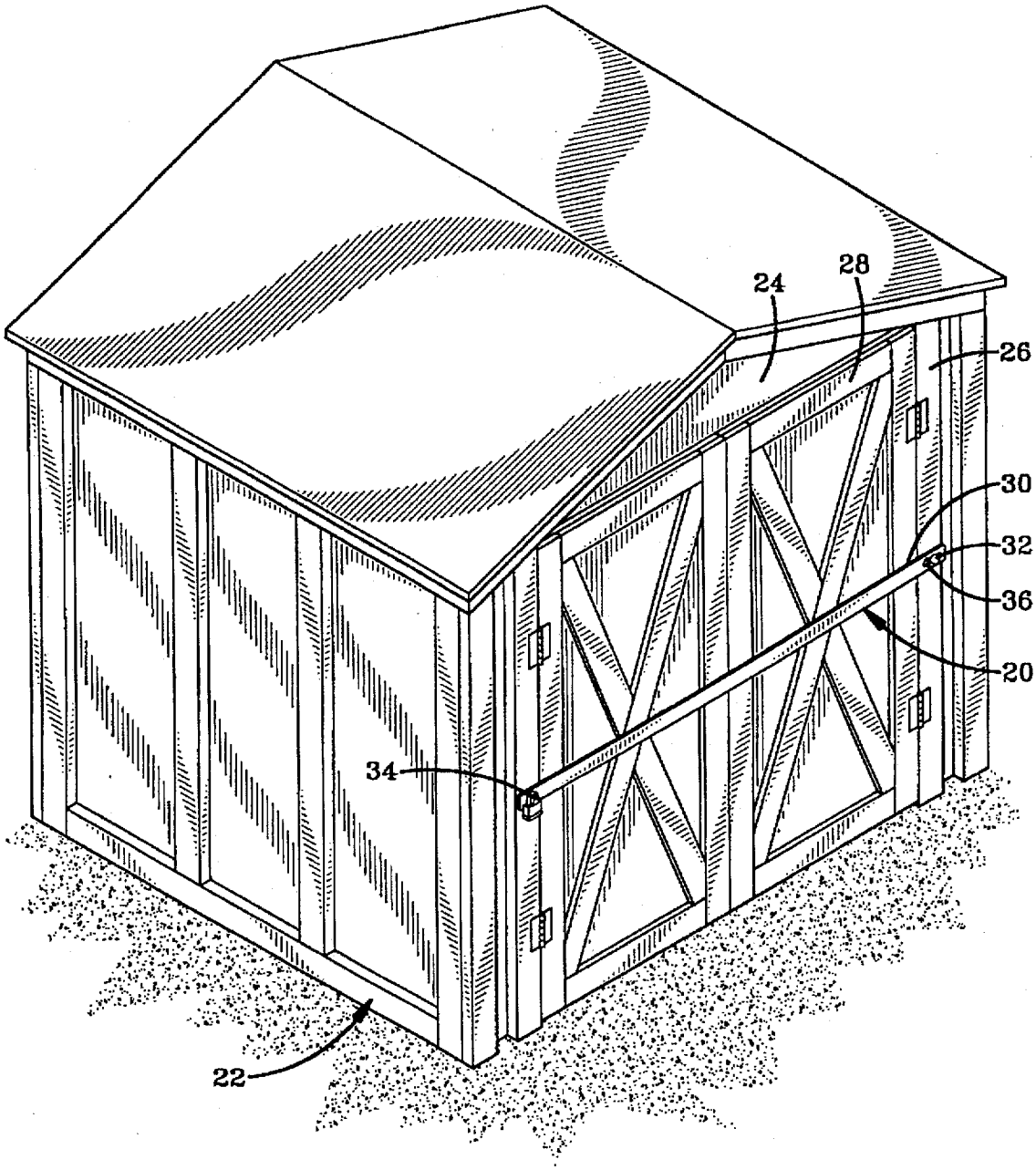
FIG. 1 is a perspective view of the door latch of the present invention mounted to a building.

The improved door latch of the invention is indicated generally at 20 and is illustrated particularly in FIG. 1 affixed to a building 22 such as a shed, barn, or other out-building. Building 22 has a number of walls including front wall 24. These walls function to define an enclosed and defined area inside the walls to securely store personal belongings. Access to this inside is provided through an opening defined by door frame 26. At least one door 28 is hingedly attached to door frame 26. A pair of doors 28 is pivotally connected to door frame 26 by hinges or other door connection mechanisms.

Door latch 20 includes a first lock post 32, a second lock post 34, a rigid bar 30 affixedly mounted to lock posts 32 and 34, and a pad lock 74 having a U-shaped bolt 75 for securing bar 30 against movement relative to lock post 32 and 30.

Elongated, rigid bar 30 is substantially rectangular in cross-section with two parallel and spaced-apart surfaces connected along their axial length by two opposing edges and connected along the short sides by two opposing ends. A first aperture 36 is formed in one end of bar 30, and a second aperture 38 is formed in the other end of bar 30.

First aperture 36 is keyhole shaped and includes an enlarged circular hole 42 at one end of the slot. Elongated slot 40 extends axially through and approximately along the centerline of elongated rigid bar 30. Enlarged circular hole 42 has a diameter greater than the width of elongated slot 40. Preferably, circular hole 42 is centered between the long sides of the rectangular faces of elongated rigid bar 30. First aperture 36 is sized to be received onto first lock post 32.

Second aperture 38 includes a circular hole 44 overlapping elongated notch 46. Elongated notch 46 extends into bar 30 from the lower edge thereof (FIG. 3). Preferably, circular hole 44 is centered between the long sides of the rectangular faces of the elongated rigid bar 30. The overlap between hole 44 and notch 46 defines an access gap 72 of a lesser width than the diameter of circular hole 44. Second aperture 36 is sized to be received on second lock post 34.

First lock post 32 has a structure connection section 47 (FIG. 7) and an elongated bar receiving section 48. Elongated bar receiving section 48 includes an enlarged head 50 at its end and an enlarged base 52 at the connection of elongated bar receiving section 48 to structure connection section 47. A narrow neck 54 extends between structure connection section 47 and bar receiving section 48. As shown in detail in FIG. 2, enlarged head 50 is rounded or semispherical in shape and narrow neck 54 and enlarged base 52 are cylindrical in shape. In accordance with one of the main features of the present invention, narrow neck 54 in combination with enlarged head 50 and enlarged base 52 defines a groove 56 between the head and base.

Enlarged head 50 and enlarged base 52 are of larger cross-sectional dimension than elongated slot 40 of bar 30 while at least enlarged head 50 is of a smaller cross sectional dimension than enlarged circular hole 42 such that enlarged head 50 is insertable through enlarged circular hole 42 but not through elongated slot 40. Enlarged base 52 is not insertable through either circular hole 42 or enlarged slot 40. Narrow neck 54 is of a smaller cross sectional dimension than elongated slot 40 and enlarged circular hole 42 such that narrow neck 54 is slidable in both enlarged circular hole 42 and elongated slot 40.

Second lock post 34 also has a structure connection section 47 and an elongated bar receiving section 58. The elongated bar receiving section 58 includes an enlarged head 60 at its end and an enlarged base 62. Narrow neck 64 is formed in second lock post 34 intermediate enlarged head 60 and enlarged base 62. As shown in detail in FIG. 2A, enlarged head 60 has a flat end 66 and is generally cylindrical in shape except for a pair of opposing flat faces 68. Narrow neck 64 and enlarged base 62 are both cylindrical. Narrow neck 64, in combination with enlarged head 60 and enlarged base 62, defining a groove 70 in between the head and base.

Enlarged head 60 and enlarged base 62 are formed with a larger cross-section than narrow access gap 72 while enlarged head 60 is of a smaller cross-section than circular hole 44 such that elongated, rigid bar 30 is pivotable about first lock post 32 so that access gap 72 passes over narrow neck 64 and circular hole 44 receives narrow neck 64. Enlarged base 62 is of a slightly smaller diameter than circular hole 44, while enlarged base 62 is of a larger diameter than the width of access gap 72, such that circular hole 44 of elongated, rigid bar 30 is slidable on second lock post 34 from narrow neck 64 to enlarged base 62 where elongated, rigid bar 30 is not pivotable about first lock post 32 (i.e., bar 30 is not pivotable away from second lock post Both the first and second lock posts 32 and 34 are elongated posts with structure connection sections 47 and elongated bar receiving sections 48. As is shown in FIG. 7, the structure connection section 47 is an elongated threaded rod insertable through a hole in front wall 24, door frame 26, or door 28 of building 22. On the inside surface of the wall, frame, or door, a standard nut or other fastener secures the lock post to the wall, frame, or door. In addition, a strength plate 80 with a hole therein may be inserted in between the wall, frame, or door and the nut or other fastener. A lag bolt having a pointed edge may be utilized in place of elongated threadable rod to directly engage the door, door frame or other structural part of the building.

In application, first and second lock posts 32 and 34 are affixed to door frame 26 as is shown in FIGS. 1, 2 and 2A. First lock post 32 is then inserted through first aperture 36 as is shown in FIG. 3. Specifically, enlarged head 50 is inserted through enlarged circular hole 42 such that elongated rigid bar 30 is aligned in a planar fashion with narrow neck 54. At this point, bar 30 is not in contact with second lock post 34 as is shown in FIG. 3A. Furthermore, bar 30 is not directly above second lock post 34, and instead is offset toward first lock post 32.

Elongated, rigid bar 30 is then slid toward second lock post 34 such that first lock post 32 slides in first aperture 36 from enlarged circular hole 42 into elongated slot 40 as is shown in FIG. 4. This sliding motion into elongated slot 40 locks bar 30 onto first lock post 32 based upon the larger cross section of enlarged head 50 in comparison to the width dimension of elongated slot 40. At this point, bar 30 is still not in contact with second lock post 34 as is shown in FIG. 4A.

However, bar 30 is approximately directly above second lock post 34 such that pivoting of bar 30 about first lock post 32 toward second lock post 34 would result in second lock post 34 seating within second aperture 38. This pivoting of bar 30 and seating of second lock post 34 within second aperture 38 is shown in FIG. 5A where circular hole 44 receives narrow neck 64 after narrow neck 64 passes through elongated notch 46 and access gap 72 (FIG. 5 shows that the position of first lock post with reference to bar 30 has remained unchanged). The seating is more clearly shown in FIG. 6.

The next step involves pushing bar 30 over enlarged base 62 as is shown in FIG. 8A. The result is that bar 30 is secured from pivoting about first lock post 32 because enlarged base 62 is of a larger diameter than access gap 72.

Figure 9:
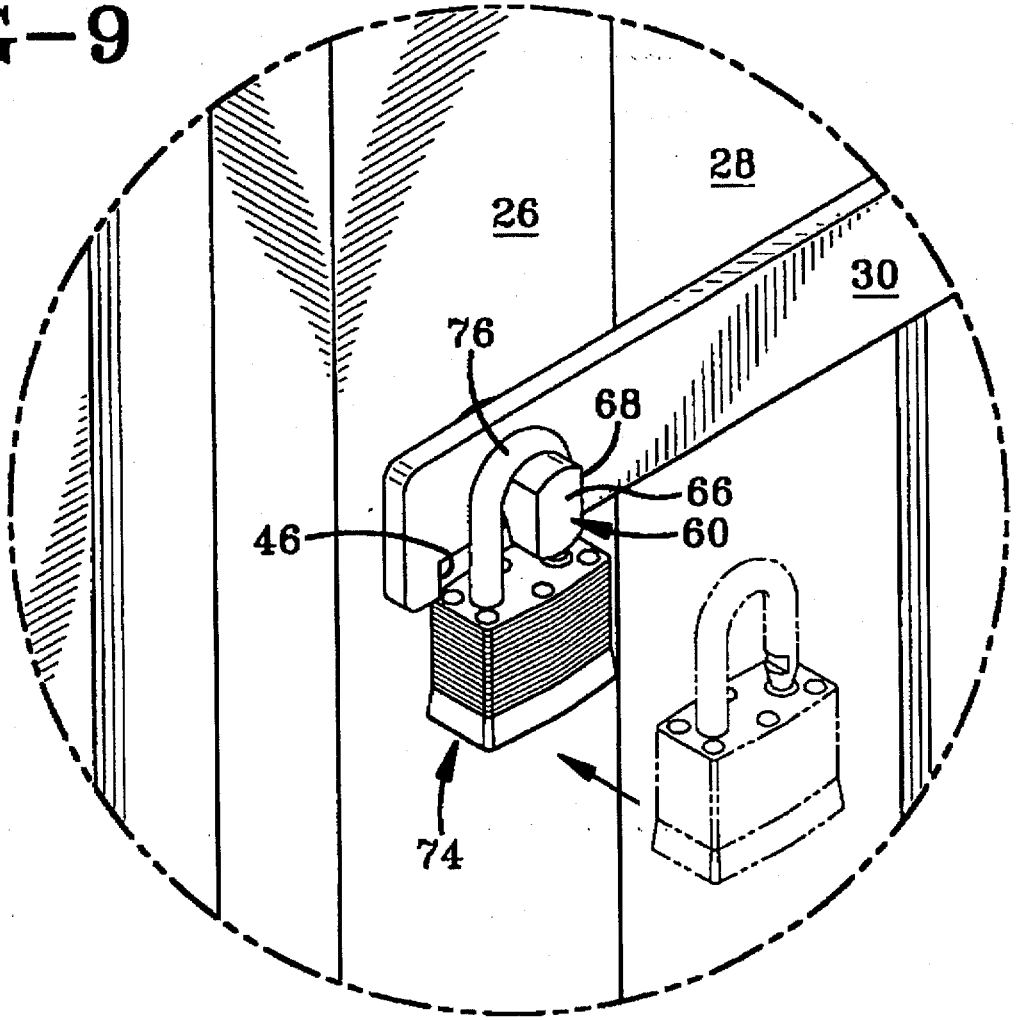
FIG. 9 is a fragmentary perspective view similar to FIG. 8A with an open padlock shown in dot-dash lines positioned away from the door latch, and in solid lines positioned within the circumferential groove of the second lock post.
Figure 11:
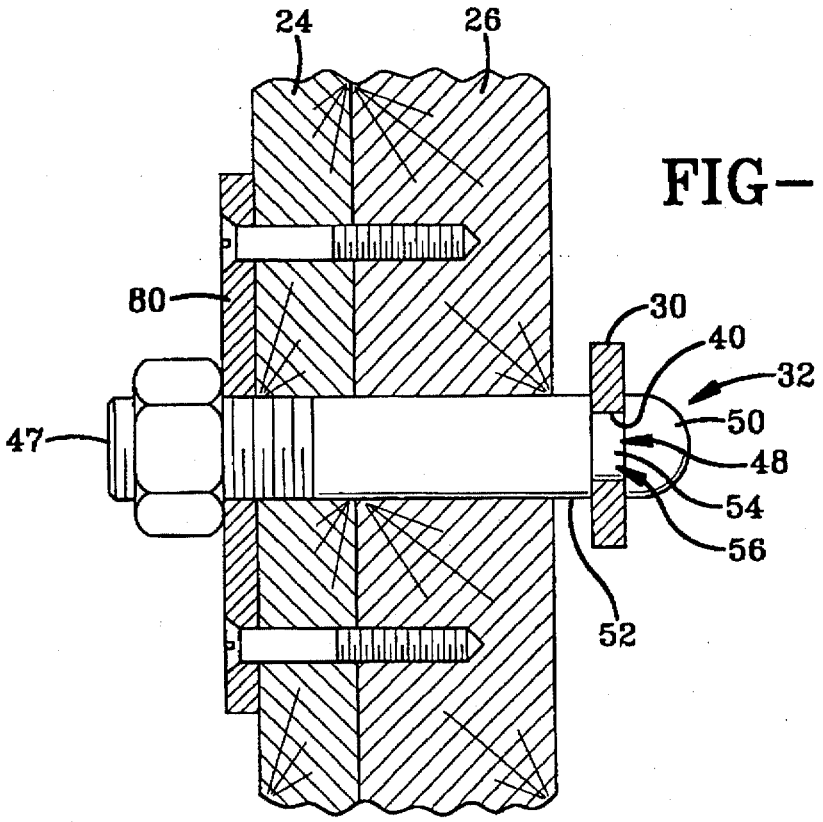
FIG. 11 is a sectional view of the first lock post and the elongated, rigid bar taken along line 11—11, FIG. 10.
Figure 12:
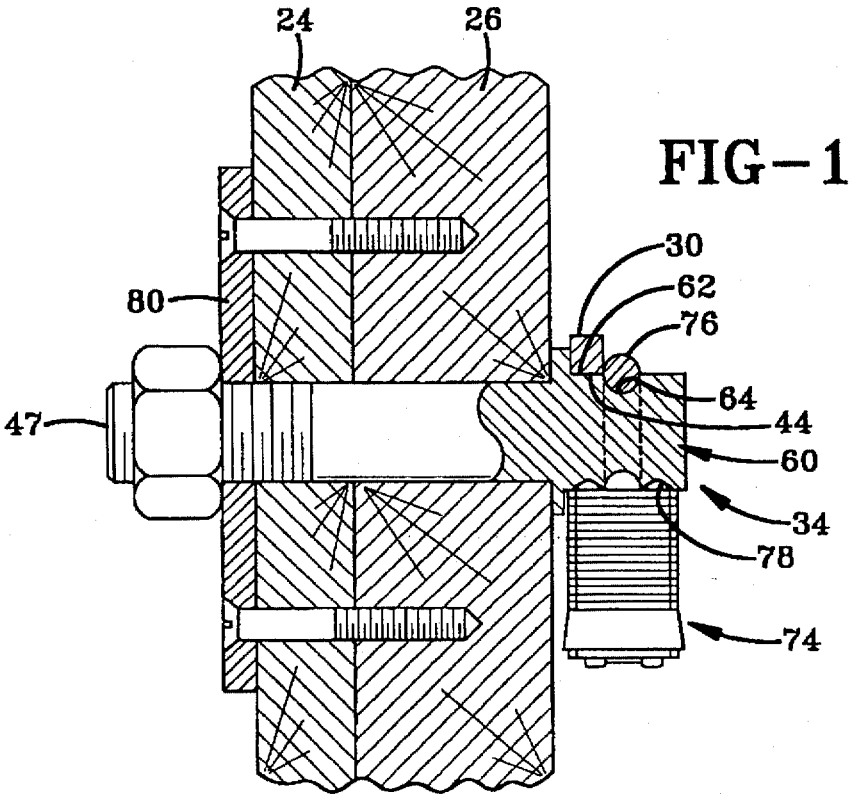
FIG. 12 is a sectional view of the second lock post taken along line 12—12, FIG. 10A.

Lock 74 then is positioned on second lock post 34 as is shown in FIG. 9. U-shaped bolt 75 is the part of the lock that extends and retracts from the body of the lock where one side of the U-shaped bolt is permanently attached to the lock body while the other side is removable and pivotable about the permanently attached side when the U-shaped bolt is extended. In accordance with one of the features of the present invention, U-shaped bolt 76 snugly fits over narrow neck 64 such that access to the U-shaped bolt is restricted when the lock is closed as is shown in FIG. 12. More particularly, the surface of narrow neck 64 extends circumferentially around a portion of U-shaped bolt 76 as a result of the position of U-shaped bolt 76 within narrow neck 64. Closure of the lock 74 onto the second lock post 34 is shown in FIG. 10A. At this point, lock 74 has slid into elongated notch 46 to further restrict access to the lock. Narrow neck 54 is firmly held in elongated slot 40 as is shown in FIGS. 9–11, and circular hole 44 is snugly fit over enlarged base 62 and U-shaped bolt 76 is locked over narrow neck 64 as is shown in FIGS. 10A and 12 thereby prohibiting elongated, rigid bar 30 from movement in any direction. Doors 28 are thus secured against movement.

Figure 13:
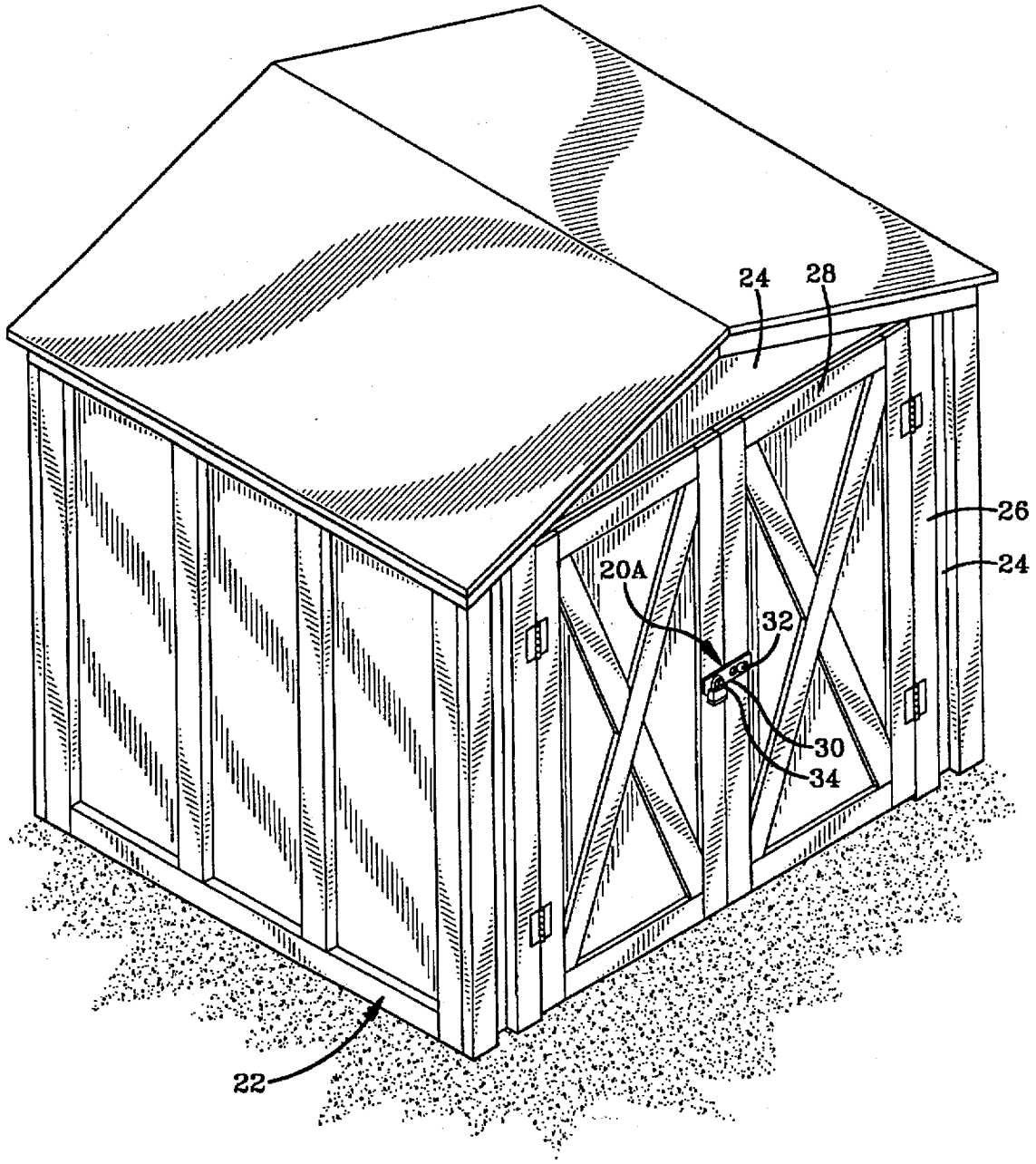
FIG. 13 is an alternative embodiment of the door securing device where the elongated, rigid bar extends only between adjacent parts of a pair of doors instead of between the opposite frame sections.

An alternative embodiment 20A is shown in FIG. 13 where the bar 30 does not extend completely across the door 28 or doors 28, and instead is affixed to adjacent portions of adjacent doors 28. In all other aspects the door securing mechanism 20A is the same as door securing mechanism 20 described above.

Accordingly, the improved door latch is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved door latch is constructed and used, the characteristics of the construction, and the advantageous, new and useful results obtained; the new and useful structures, devices, elements, arrangements, parts and combinations, are set forth in the appended claims.

I claim:

1. A door latch for securing an access door into a secured area against unwanted entry, said door securing device comprising:

an elongated, rigid bar having first and second openings therein;

a first lock post insertable in the first opening and selectively securable therein; and a second lock post insertable in the second opening and including a pad lock receiving groove circumferentially therearound for selectively securing the elongated, rigid bar to the second lock post.

2. The door securing device as set forth in claim 1 wherein the first opening is keyhole shaped.

3. The door securing device as set forth in claim 2 wherein the first opening comprises an elongated slot with an enlarged hole operatively connected with the slot.

4. The door securing device as set forth in claim 3 wherein the first lock post comprises an enlarged head formed at one end of the post; an enlarged base; a narrow neck positioned intermediate the head and base; and a groove extending at least partially around the narrow neck whereby the groove is slidably received within the slot.

5. The door securing device as set forth in claim 1 wherein the second opening comprises a hole in the elongated, rigid bar with an access gap cut out from the hole.

6. The door securing device as set forth in claim 5 wherein the second opening further comprises an elongated notch that overlaps the hole to define the narrow access gap between the hole and notch whereby the gap is of a smaller width than the diameter of the hole.

7. The door securing device as set forth in claim 1 wherein both the first and second lock posts each comprises a narrow neck attached to an enlarged head.

8. The door securing device as set forth in claim 7 wherein the second lock post further comprises an enlarged base which in combination with the enlarged head defines the pad lock receiving groove therebetween.

9. The door securing device as set forth in claim 8 wherein the second opening comprises a hole in the elongated, rigid bar with a narrow access gap cut out from the hole.

10. The door securing device as set forth in claim 9 wherein the second opening further comprises an elongated notch that overlaps the hole to define the narrow access gap between the hole and notch whereby the gap is of a smaller width than the diameter of the hole.

11. The door securing device as set forth in claim 10 wherein the first opening is keyhole shaped.

12. The door securing device as set forth in claim 11 wherein the first opening comprises an elongated slot operatively communicating with an enlarged hole for receiving the enlarged head of the first lock post.

13. A door securing device for securing an access door into a secured area against unwanted entry, said door securing device comprising:

an elongated, rigid bar having first and second ends:

a slot formed in the elongated, rigid bar adjacent one of the first and second ends;

a first lock post including an enlarged head thereon;

first connecting means for connecting and subsequently slidably engaging the first lock post to the elongated, rigid bar;

a second lock post including a circumferential groove for receiving a lock; and second connecting means for connecting the second lock post to the elongated, rigid bar.

14. The door securing device as set forth in claim 13 wherein the first lock post further comprises an enlarged base; a narrow neck positioned intermediate the head and base; and a groove extending at least partially around the narrow neck whereby the groove is slidably received within the slot.

15. The door securing device as set forth in claim 13 wherein the second lock post comprises a narrow neck attached to an enlarged head at one end and an enlarged base which define the circumferential groove for receiving a lock.

16. A method of securing an access door into a secured area against unwanted entry, said method comprising:

locking a first end of an elongated, rigid bar to a first lock post affixed to a boundary defining a secured area;

positioning a second end of the elongated, rigid bar so that a narrow gap formed in the second end of the elongated, rigid bar slips over a groove on a second lock post resulting in the second end of the rigid bar resting on the second lock post in a hole in the second end of the elongated, rigid bar;

sliding the hole over a collar on the second lock post of larger cross-section than both the gap and the groove; and locking a pad lock in the groove on the second lock post.

17. The method as set forth in claim 16 wherein the step of locking further comprises:

slipping/moving a circular hole in a first opening in the first end of the elongated, rigid bar over an elongated head on the first lock post; and sliding the first lock post along a slot communicating with the first opening formed in the rigid bar and having a smaller width than the circular hole.

18. The method as set forth in claim 16 wherein the step of positioning further comprises:

aligning the narrow gap in the second end of the elongated, rigid bar with the groove on the second lock post; and pivoting the second end of the elongated, rigid bar about the first lock post so that the narrow gap in the second end of the elongated, rigid bar slips over the groove on the second lock post resulting in the second end of the rigid bar resting on the second lock post.

19. The method as set forth in claim 18 wherein the step of sliding further comprises:

preventing pivotal disengagement of the elongated, rigid bar from the second lock post by sliding the hole axially along the second lock post and over a collar on the second lock post of larger cross-section than both the gap and the groove.

* * * * *